US007909455B2

(12) United States Patent
Hiroki et al.

(10) Patent No.: US 7,909,455 B2
(45) Date of Patent: Mar. 22, 2011

(54) METHOD AND APPARATUS FOR FORMING IMAGE

(75) Inventors: Masashi Hiroki, Yokohama (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1113 days.

(21) Appl. No.: 11/619,724

(22) Filed: Jan. 4, 2007

(65) Prior Publication Data

US 2008/0165240 A1 Jul. 10, 2008

(51) Int. Cl.
*B41J 2/01* (2006.01)
*B41J 29/13* (2006.01)

(52) U.S. Cl. ..... 347/108; 347/104

(58) Field of Classification Search ..... 347/108
See application file for complete search history.

(56) References Cited

U.S. PATENT DOCUMENTS

2005/0253886 A1* 11/2005 Nakajima et al. ..... 347/16
2008/0165215 A1 7/2008 Hiroki et al.
2008/0165218 A1 7/2008 Hiroki et al.
2008/0165220 A1 7/2008 Hiroki et al.
2008/0165231 A1 7/2008 Hiroki et al.
2008/0165236 A1 7/2008 Hiroki et al.
2008/0165238 A1 7/2008 Hiroki et al.
2008/0165239 A1 7/2008 Hiroki et al.
2008/0165241 A1 7/2008 Hiroki et al.
2008/0165242 A1 7/2008 Hiroki et al.

FOREIGN PATENT DOCUMENTS

JP 10285316 A * 10/1998
JP 2005-204163 7/2005
JP 2006-142605 6/2006

* cited by examiner

*Primary Examiner* — Matthew Luu
*Assistant Examiner* — Kendrick X Liu
(74) *Attorney, Agent, or Firm* — Turocy & Watson, LLP

(57) ABSTRACT

An image forming apparatus includes an image forming unit and a supporting mechanism that supports this image forming unit. A feed tray for placing sheets thereon is provided in a rear part of the image forming unit. The supporting mechanism includes a base member and a turntable. The turntable can move along a guide section to a first position on a rear side and a second position on a front side with respect to the base member. The supporting mechanism includes a rotation stopping mechanism that prevents the turntable from rotating when the turntable is in the first position and a rotating mechanism that rotates the turntable in a horizontal plane in a state in which the turntable has moved to the second position.

3 Claims, 8 Drawing Sheets

METHOD AND APPARATUS FOR FORMING IMAGE

BACKGROUND OF THE INVENTION

1. Field of the Invention

The present invention relates to an image forming apparatus including a recording head for printing an image on a sheet such as a print sheet, and, more particularly to an image forming apparatus that has a feed tray.

2. Description of the Related Art

An image forming apparatus having a recording head includes, other than the recording head and an apparatus body having a sheet conveying mechanism, a feed tray for placing sheets such as print sheets and a discharge tray for discharging a sheet having an image formed thereon. For example, in an image forming apparatus described in JP-A-2006-142605, a feed tray is arranged in the rear part of an apparatus body and a discharge tray is arranged in the front part of the apparatus body.

When the feed tray is arranged in the rear part of the apparatus body as in the conventional image forming apparatus, the feed tray is in a position distant from an operator. Therefore, it is difficult for the operator to view sheets on the feed tray and perform work for supplying sheets to the feed tray. Moreover, it may be difficult to set sheets in an accurate position of the feed tray.

It is an object of the invention to provide an image forming apparatus and an image forming method with which it is possible to easily set sheets in a feed tray.

BRIEF SUMMARY OF THE INVENTION

The invention provides an image forming apparatus that has an image forming unit including a recording head for printing an image on a sheet. The image forming apparatus includes a feed tray that is provided in the rear part of the image forming unit and on which the sheet is placed and a supporting mechanism on which the image forming unit is placed. The supporting mechanism includes a base member that has an upper surface, a turntable that is arranged on the base member and is movable along the upper surface of the base member, a guide section that guides the turntable to move from a first position to a second position further on a front side than the first position with respect to the base member, a rotation stopping mechanism that prevents the turntable from rotating when the turntable is in the first position, and a rotating mechanism that allows the turntable to rotate around an axis in an up-to-down direction in a state in which the turntable has moved to the second position.

In one aspect of the invention, the image forming apparatus includes a lock mechanism that can fix the turntable to the base member. Further, the image forming apparatus may include a control unit that permits printing when the lock mechanism is in a lock position and prohibits printing when the lock mechanism is in a lock release position.

Objects and advantages of the invention will become apparent from the description, which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

Figure 1:
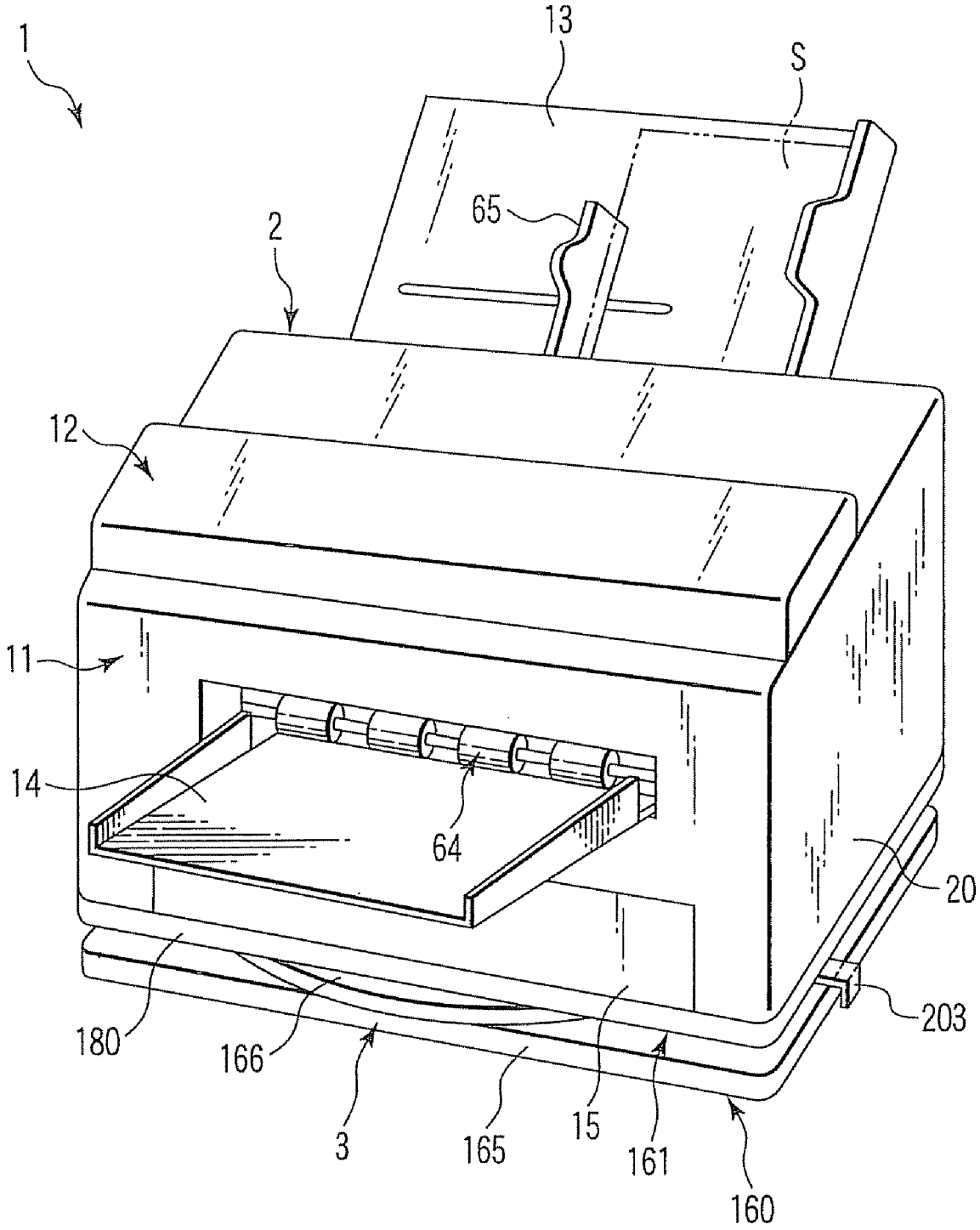
FIG. 1 is a perspective view of an image forming apparatus according to an embodiment of the invention.

An image forming apparatus according to an embodiment of the invention will be explained with reference to FIGS. 1 to 9. FIG. 1 shows an appearance of an image forming apparatus 1. The image forming apparatus 1 has a function of printing an image on a sheet S such as a print sheet. This image forming apparatus 1 includes an image forming unit 2 that is an apparatus main body and a supporting mechanism 3 arranged on the lower side of the image forming unit 2. The supporting mechanism 3 will be explained in detail later.

The image forming unit 2 has a main body unit 11, a head housing unit 12 arranged on the main body unit 11, a first feed tray 13 arranged in a rear part of the main body unit 11, a discharge tray 14 arranged in a front part of the main body unit 11, a second feed tray 15 housed in a lower part of the main body unit 11, and the like.

Figure 2:
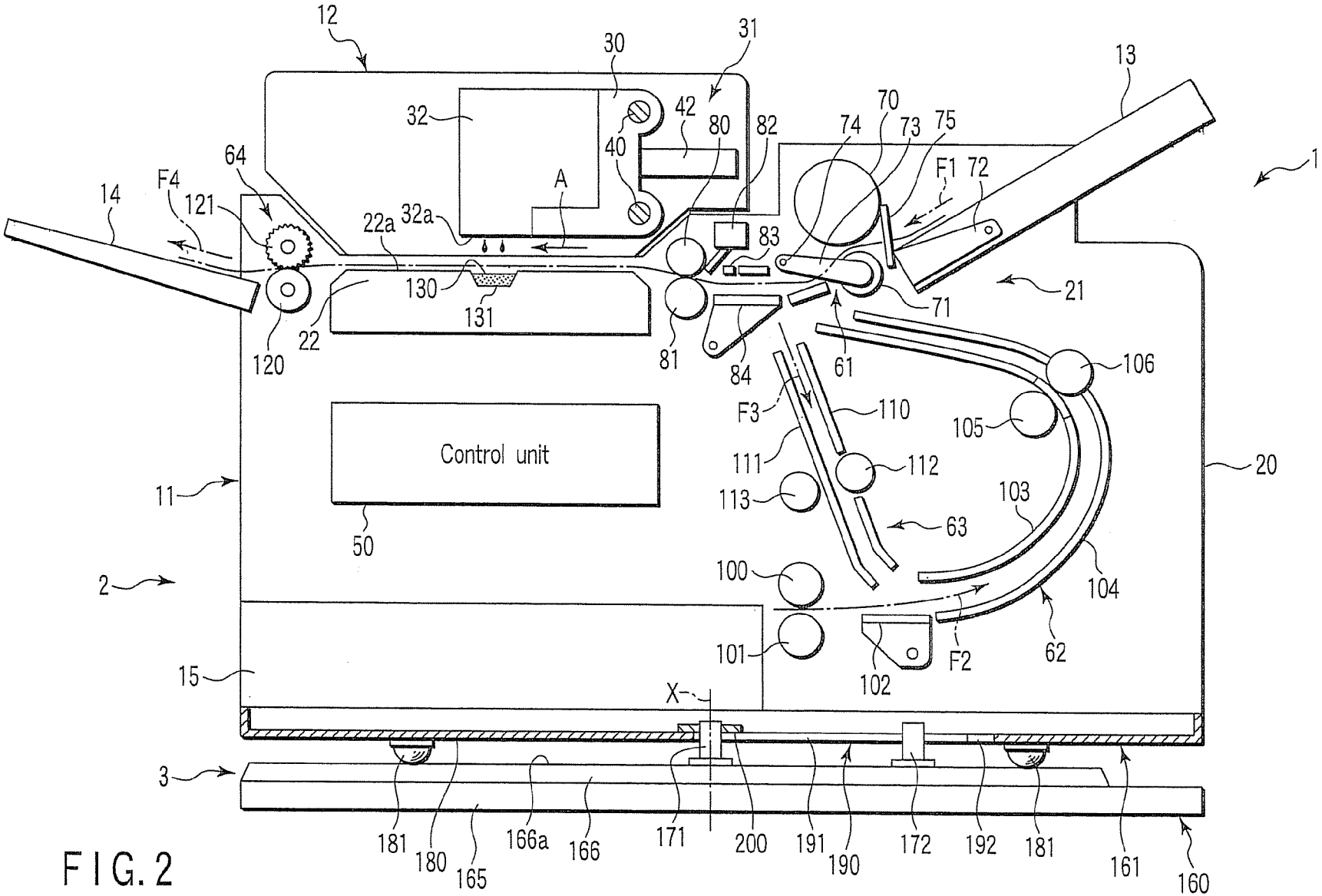
FIG. 2 is a side view schematically showing the inside of the image forming apparatus shown in FIG. 1.

FIG. 2 schematically shows the inside of the image forming apparatus 1. The main body unit 11 includes a housing 20, a sheet conveying mechanism 21 constructed in the inside of the housing 20, a sheet guide member 22 that has a guide section 22*a* in the horizontal direction, and a head maintenance unit 24 shown in FIG. 3.

A carriage 30, a carriage driving mechanism 31 for driving this carriage 30, a recording head 32 of an ink-jet system mounted on the carriage 30, and the like are arranged in the head housing unit 12. A replaceable ink cartridge (not shown) is housed in the recording head 32. As shown in FIG. 2, the recording head 32 has a nozzle section 32*a* opening downward to the guide section 22*a* of the sheet guide member 22 and an ink ejecting mechanism (not shown) that ejects an ink from the nozzle section 32*a*. The recording head 32 forms an image on a sheet S (shown in FIG. 3) with this ink. An arrow A in FIG. 3 indicates a conveying direction of the sheet S.

An example of the ink ejecting mechanism is a thermal type. The thermal type applies heat to the ink with a heater built in the recording head 32 to film-boil the ink. A pressure change is caused in the ink by growth or contraction of air bubbles due to this film boiling. An image is formed on the sheet S by ejecting the ink from the nozzle section 32*a* according to this pressure change. Other than the thermal type, for example, an ink ejecting mechanism that uses an element (e.g., a piezoelectric element) having a piezoelectric effect may be adopted. For example, the piezoelectric element is deformed by an electric current and an ink is ejected from a nozzle section according to a pumping action based on the deformation.

Figure 3:
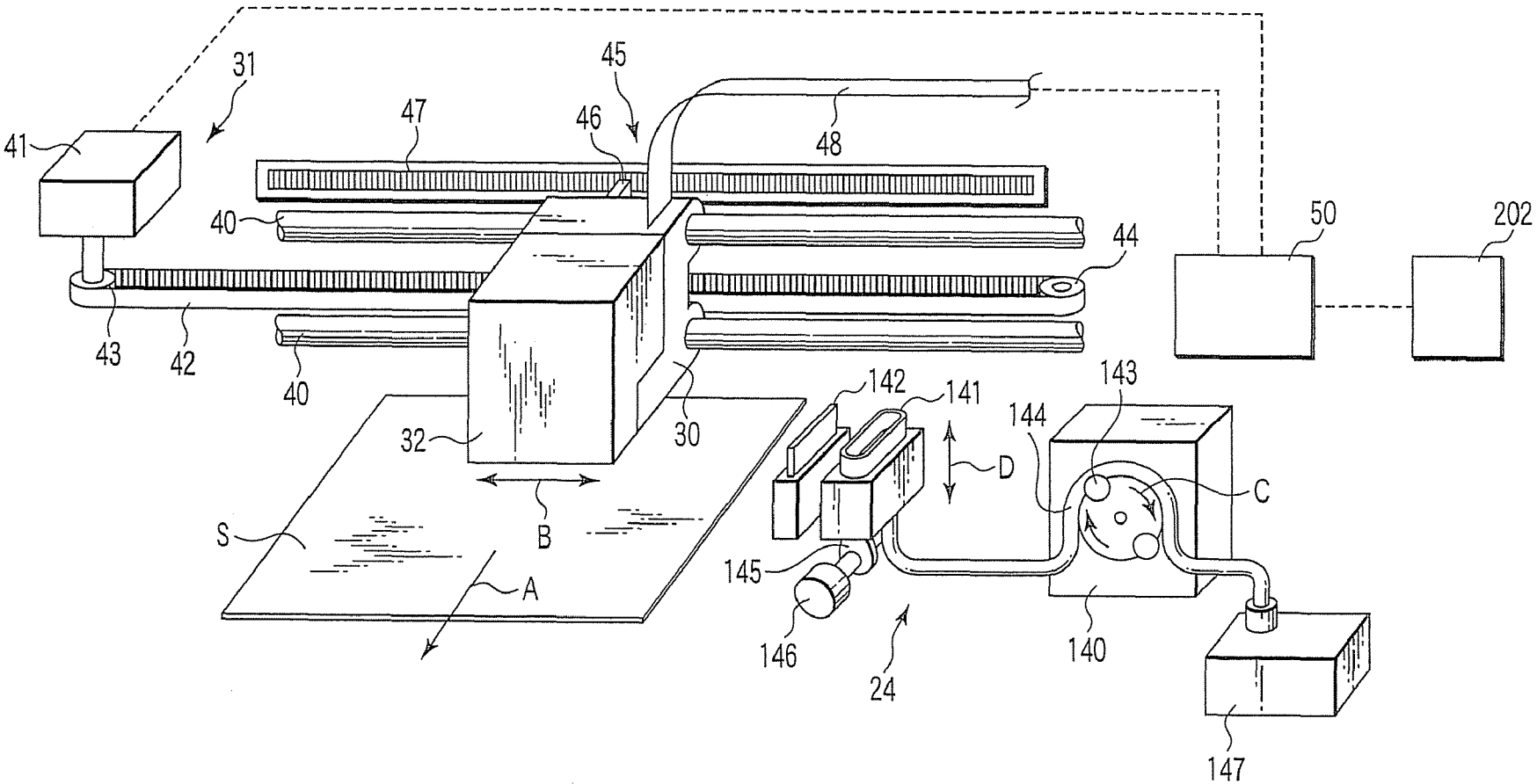
FIG. 3 is a perspective view of a carriage driving mechanism and a head maintenance mechanism of the image forming apparatus shown in FIG. 1.

As shown in FIG. 3, the carriage driving mechanism 31 includes a carriage guide 40 extending in the horizontal direction, a motor 41 such as a stepping motor, power transmitting members such as a timing belt 42 and sprockets 43 and 44, and a sensor unit 45 for controlling a position of the carriage 30. The carriage guide 40 extends in a direction B orthogonal to the conveying direction of the sheet S. The carriage guide 40 is supported by a frame of the head housing unit 12. The recording head 32 can reciprocatingly move in a direction (the arrow B direction) orthogonal to the conveying direction of the sheet S together with the carriage 30 along the carriage guide 40.

The rotation of the motor 41 is transmitted to the carriage 30 via the timing belt 42. Therefore, the recording head 32 reciprocatingly moves along the carriage guide 40. The sensor unit 45 for controlling a position of the carriage 30 includes, for example, an encoder sensor 46 and a ladder plate 47 serving as a section to be detected. The ladder plate 47 extends in a direction parallel to the carriage guide 40. The ladder plate 47 has a ladder pattern formed at equal pitches. The ladder pattern of the ladder plate 47 is optically detected by the encoder sensor 46 according to the position of the carriage 30, whereby the position of the carriage 30 is detected. A signal of the position detected is inputted to a control unit 50 via a flexible harness 48.

The control unit 50 has a function of controlling a printing operation of the image forming apparatus 1 and includes, for example, a control circuit for controlling the sheet conveying mechanism 21, a control circuit for controlling the carriage driving mechanism 31, and a control circuit that manages an ink ejecting operation of the recording head 32.

As shown in FIG. 2, the sheet conveying mechanism 21 includes a first conveying unit 61, a second conveying unit 62, a duplex-printing conveying unit 63 used in performing duplex printing, and a discharging mechanism 64. The first conveying unit 61 conveys a sheet taken out from the first feed tray 13 to the recording head 32. The second conveying unit 62 conveys a sheet taken out from the second feed tray 15 to the recording head 32. The discharging mechanism 64 has a function of discharging a sheet having an image printed thereon onto the discharge tray 14.

It is possible to place plural sheets (e.g., print sheets) on the first feed tray 13 stacking the sheets in the thickness direction. As shown in FIG. 1, a movable guide 65 is provided in the first feed tray 13. The movable guide 65 is movable in the width direction of the sheet S according to a size of the sheet S. It is possible to regulate a position in the width direction of the sheet S on the first feed tray 13 by moving the movable guide 65 in the width direction of the sheet S.

The first conveying unit 61 includes a feed roller 70, a separation roller 71 located below the feed roller 70, and a separation unit 72 including a separation pad. The feed roller 70 feeds a sheet taken out from the lower end of the first feed tray 13 to the recording head 32. A torque limiter is provided in the separation roller 71.

The separation roller 71 rotates in a direction identical with a direction of rotation of the feed roller 70 according to a function of the torque limiter when only one sheet is present between the separation roller 71 and the feed roller 70. When two or more sheets are present between the feed roller 70 and the separation roller 71, the separation roller 71 rotates in a direction opposite to the direction of rotation of the feed roller 70. Therefore, when plural sheets are taken out from the first feed tray 13 and fed into a space between the feed roller 70 and the separation roller 71, an uppermost sheet and the other sheets are separated and only the uppermost sheet is fed to the recording head 32. A sheet separating mechanism for taking out sheets from the first feed tray 13 one by one is constituted by the feed roller 70, the separation roller 71, the separation unit 72, and the like.

The separation roller 71 is held by a holder 73. The holder 73 is movable in the up-to-down direction around a shaft 74 extending in the horizontal direction. The separation roller 71 is brought into contact with the feed roller 70 at a predetermined load and separated from the feed roller 70 by a not-shown cam. It is possible to move the separation unit 72 in a direction toward and away from the feed roller 70 with a not-shown cam.

After the sheet is fed, the separation roller 71 and the separation unit 72 are separated from the feed roller 70, moved to standby positions, and put on standby until the next sheet feed time, respectively. A return lever 75 is rotatably arranged near the lower end of the first feed tray 13. When the sheet taken out from the first feed tray 13 is conveyed to the feed roller 70, the return lever 75 is retracted by a spring to a position where the return lever 75 does not hinder the conveyance of the sheet. This return lever 75 rotates in synchronization with the movement of the separation roller 71 and the separation unit 72 to the standby positions and feeds a remaining sheet back to the first feed tray 13.

The first conveying unit 61 includes a conveying roller 80, a pinch roller 81 opposed to this conveying roller 80, a sheet sensor 82, a media sensor 83, and a switching member 84. The conveying roller 80 feeds a sheet to a space between the sheet guide member 22 and the recording head 32. The sheet sensor 82 has a sensor arm that is capable of detecting positions of the leading end and the trailing end of the sheet.

The media sensor 83 has a function of detecting a quality (e.g., paper quality) and thickness of a sheet. For example, when the surface of the sheet is made of a material having moisture-absorption characteristics, the media sensor 83 outputs a signal for increasing a quantity of ink ejected from the recording head 32 to the control unit 50. In the case of a sheet having glossiness on the surface thereof, for example, coat paper, the media sensor 83 performs control for outputting a signal for reducing a quantity of ink ejected from the recording head 32 to the control unit 50. In the case of color printing, a ratio of ejection of plural color elements may be adjusted on the basis of a signal from the media sensor 83.

Figure 4:
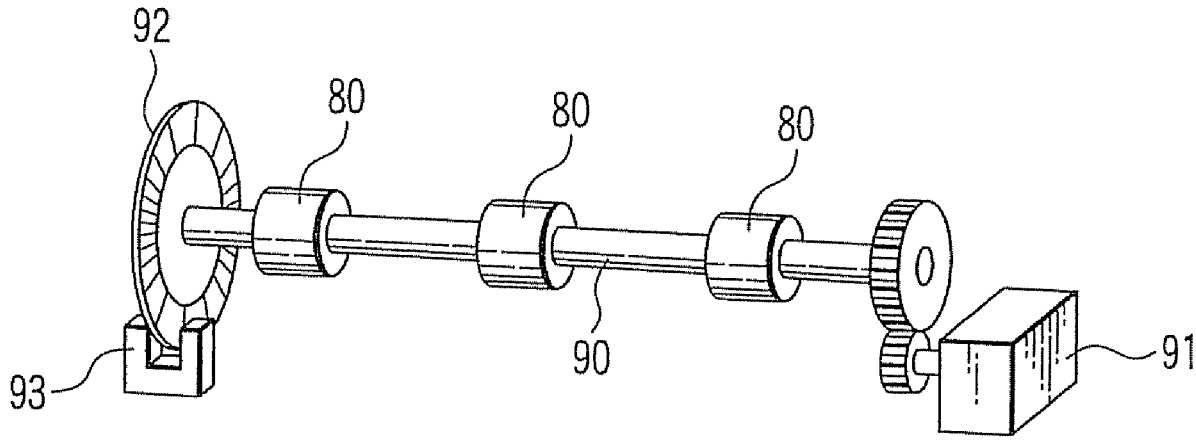
FIG. 4 is a perspective view of a part of a sheet conveying mechanism of the image forming apparatus shown in FIG. 1.

As shown in FIG. 4, the conveying roller 80 is attached to a shaft 90. The shaft 90 is rotated by a controllable motor 91 such as a stepping motor. The pinch roller 81 opposed to the conveying roller 80 is set in contact with the conveying roller 80 by a not-shown spring. A ladder wheel 92 of a disc shape is attached to the shaft 90 of the conveying roller 80. A ladder pattern is formed in a circumferential direction at fixed pitches in the ladder wheel 92. This ladder wheel 92 is detected by a sensor 93 and inputted to the control unit 50. Consequently, the rotation of the conveying roller 80 is controlled and conveyance of a sheet is controlled at the time of image formation.

A sheet taken out from the first feed tray 13 by the feed roller 70 is conveyed to a space between the conveying roller 80 and the pinch roller 81 through the first conveying unit 61 as indicated by an arrow F1 in FIG. 2. The leading end of the sheet is detected by the sheet sensor 82 and positioning for image formation is performed. This sheet passes between the upper surface (the guide section 22*a*) of the sheet guide member 22 and the recording head 32 according to the rotation of the conveying roller 80. When the sheet passes, an image is formed on the sheet S by the recording head 32. Ribs functioning as a conveyance reference surface are formed on the guide section 22*a* of the sheet guide member 22. These ribs keep the height of the sheet proper and prevent the sheet from heaving. The sheet having the image formed thereon is conveyed to the discharging mechanism 64.

The second conveying unit 62 includes rollers 100 and 101 for taking out a sheet from the second feed tray 15 of a cassette type, a switching member 102, guide members 103 and 104 for guiding the sheet taken out, a conveying roller 105 provided along the guide members 103 and 104, and a pinch roller 106 opposed to the conveying roller 105. The pinch roller 106 is pressed against the conveying roller 105 by a spring. It is possible to store plural sheets (e.g., print sheets) in the second feed tray 15 stacking the sheets in the thickness direction. The rollers 100 and 101 of the second conveying unit 62 function as sheet separating mechanisms for taking out sheets from the second feed tray 15 one by one.

A sheet taken out from the second feed tray 15 passes between the guide members 103 and 104 of the second conveying unit 62 through the switching member 102 as indicated by an arrow F2 in FIG. 2. This sheet is further conveyed to the conveying roller 80 by the rollers 105 and 106 and fed to the space between the recording head 32 and the sheet guide member 22.

The duplex-printing conveying unit 63 includes guide members 110 and 111, a conveying roller 112 provided along the guide members 110 and 111, and a pinch roller 113 opposed to the conveying roller 112. The pinch roller 113 is pressed against the conveying roller 112 by a spring. The guide members 110 and 111 are arranged between the switching member 84 of the first conveying unit 61 and the switching member 102 of the second conveying unit 62. At the time of duplex printing, a sheet is fed in an arrow F3 direction in FIG. 2. The conveying rollers 80, 105, and 112 are obtained by providing rubber-like resin such as EPDM (ethylene propylene diene rubber) on a metal shaft and have a function of conveying the sheet S with friction.

When duplex printing is performed, after an image is printed on one side of a sheet by the recording head 32, the trailing end of this sheet is detected by the sheet sensor 82. Immediately after the detection, the conveying roller 80 rotates reversely and a position of the switching member 84 is switched. Consequently, the sheet is sent to the duplex printing conveying unit 63 as indicated by the arrow F3 in FIG. 2. Moreover, this sheet is conveyed by the rollers 112 and 113 and passes between the guide members 103 and 104 of the second conveying unit 62 through the switching member 102. In this way, the front and the back of the sheet are reversed and this sheet is sent to the recording head 32 again by the conveying roller 80, whereby an image is printed on the other side of the sheet.

The discharging mechanism 64 has a discharge roller 120, a star wheel 121, a transmitting mechanism (not shown) for transmitting the rotation of the conveying roller 80 to the discharge roller 120 and the star wheel 121, and the like. The star wheel 121 is a wheel of a gear shape made of a thin plate of stainless steel or the like. A sheet having an image printed thereon by the recording head 32 is conveyed in a direction indicated by an arrow F4 to the discharge tray 14 while being pressed against the discharge roller 120 by the star wheel 121. The sheet after printing is prevented from floating from the discharge roller 120 by this start wheel 121.

As shown in FIG. 2, an ink absorbing section 130 is formed on the upper surface side of the sheet guide member 22. The ink absorbing section 130 is opposed to the nozzle section 32*a* of the recording head 32 and formed in a position lower than the guide section 22*a*. The width of the ink absorbing section 130 is larger than the width of the sheet S. For example, a sponge-like ink absorbing member 131 is housed in the ink absorbing section 130. When rimless printing on a sheet is performed, an excess ink ejected on the outside of the edge of the sheet is absorbed by this ink absorbing member 131, whereby following sheets are prevented from being stained.

The head maintenance unit 24 shown in FIG. 3 includes a suction device 140 for performing cleaning of the recording head 32, a cap 141 for preventing the recording head 32 from drying, and a blade member 142 for cleaning the nozzle section 32*a* of the recording head 32. An example of the suction device 140 strokes a tube 144 in a direction indicated by an arrow C with a body of rotation 143 to generate a negative pressure on the inner side of the cap 141.

It is possible to move the cap 141 in an up-to-down direction (an arrow D direction in FIG. 3) with a cap driving unit 145. The cap driving unit 145 moves the cap 141 up and down with an actuator 146 such as a solenoid as a driving source. A waste ink tank 147 is connected to the suction device 140. The rotation of a motor may be converted into a linear motion by a cam, a link mechanism, or the like to move the cap 141 up and down. In maintaining the recording head 32, in order to remove foreign matters adhering to the nozzle section 32*a*, a small quantity of ink may be ejected from the nozzle section 32*a*.

In the case of head maintenance, the recording head 32 is moved to a predetermined maintenance position by the carriage driving mechanism 31. Thereafter, the cap 141 is lifted to the recording head 32 by the cap driving unit 145 and the cap 141 comes into close contact with the recording head 32. The cap 141 covers the nozzle section 32*a*. Consequently, a remaining ink adhering to the nozzle section 32*a* is prevented from drying. In this state, the suction device 140 is actuated to generate a negative pressure on the inner side of the cap 141, whereby the remaining ink adhering to the nozzle section 32*a* is sucked. The waste ink sucked is discharged to a waste ink tank 147. Thereafter, the cap 141 moves away from the recording head 32 and the nozzle section 32*a* is cleaned by the blade member 142.

As shown in FIGS. 1 and 2, the supporting mechanism 3 is provided below the image forming unit 2. The supporting mechanism 3 is explained below.

Figure 5:
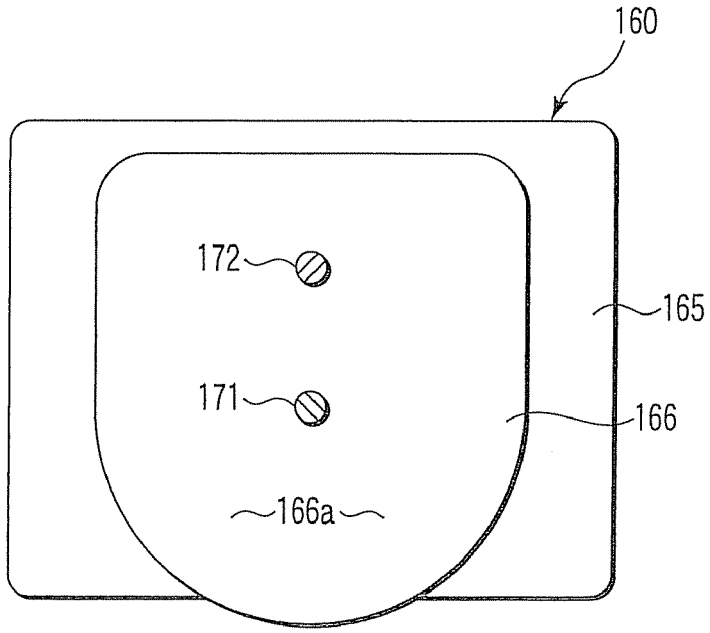
FIG. 5 is a plan view of a base member of a supporting mechanism of the image forming apparatus shown in FIG. 1.
Figure 6:
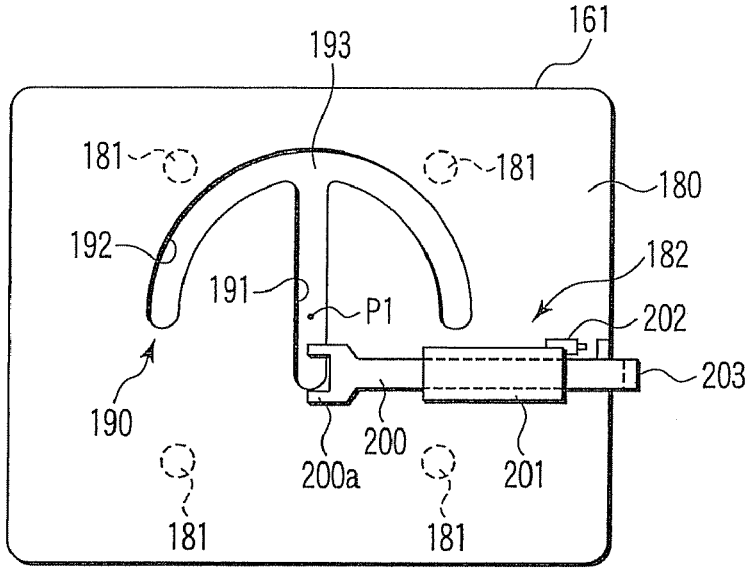
FIG. 6 is a plan view of a movable unit of the supporting mechanism of the image forming apparatus shown in FIG. 1.

The supporting mechanism 3 includes a base member 160 shown in FIG. 5 and a movable unit 161 shown in FIG. 6. The base member 160 includes a base plate 165, a support plate 166, a first shaft 171, and a second shaft 172. The first shaft 171 and the second shaft 172 project upward from an upper surface 166*a* of the support plate 166, respectively. The upper surface 166*a* of the support plate 166 is substantially flat.

The movable unit 161 shown in FIG. 6 includes a turntable 180, plural casters 181 provided on the lower surface of the turntable 180, and a lock mechanism 182. The casters 181 are, for example, ball casters and can turn in a state of contact with the upper surface 166*a* of the support plate 166. With these casters 181, the turntable 180 can move in the horizontal direction along the upper surface 166*a* of the support plate 166.

A guide section 190 is formed in the turntable 180. The guide section 190 includes a first guide 191 formed by a linear slit and a second guide 192 formed by an arcuate slit. The first guide 191 extends in a front-to-rear direction of the turntable 180. The second guide 192 is an arc with a midpoint P1 along a longitudinal direction of the first guide 191 as the center. The first guide 191 and the second guide 192 communicate with each other via a communicating section 193.

Figure 7:
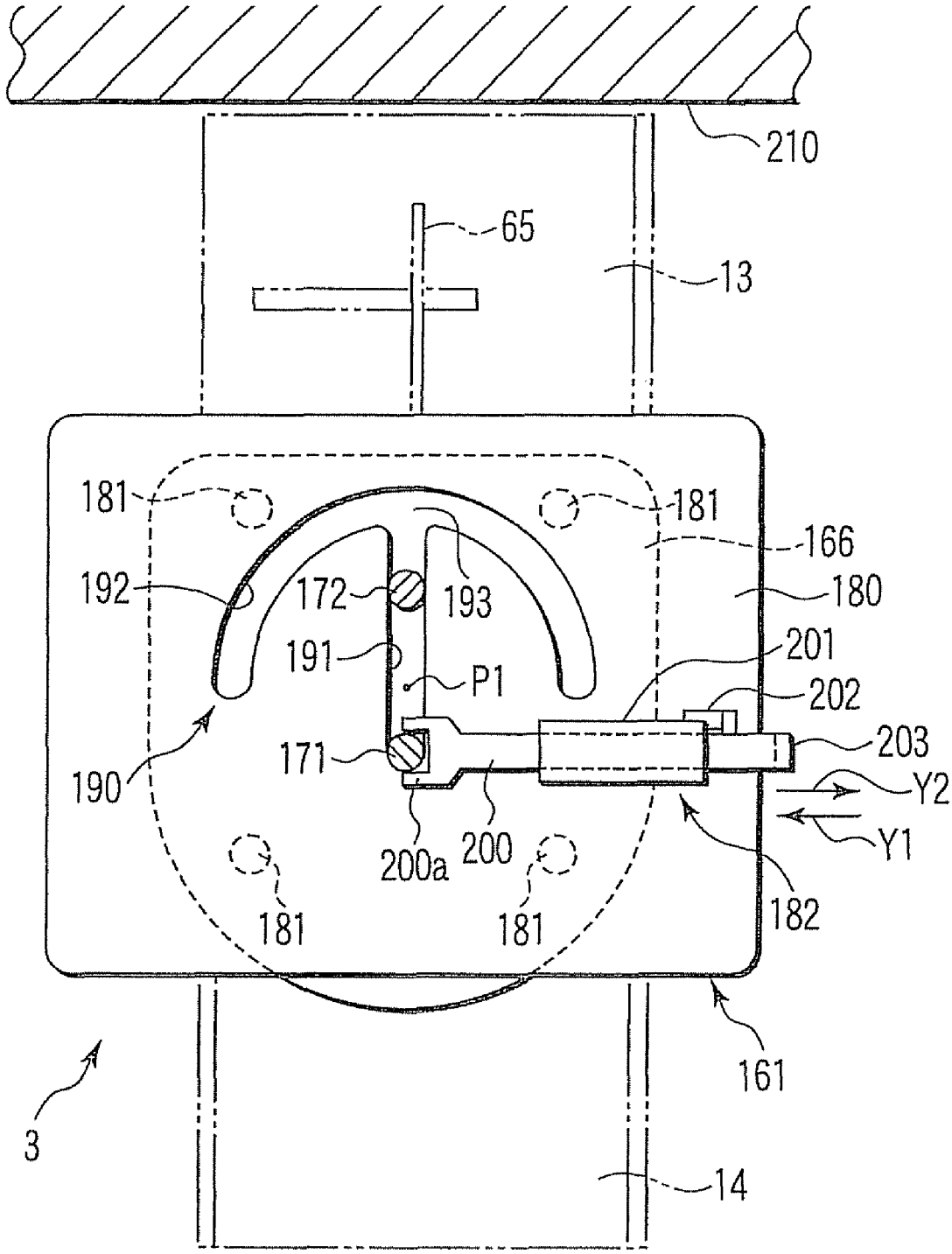
FIG. 7 is a plan view in which the movable unit of the supporting mechanism of the image forming apparatus shown in FIG. 1 is in a first position.
Figure 8:
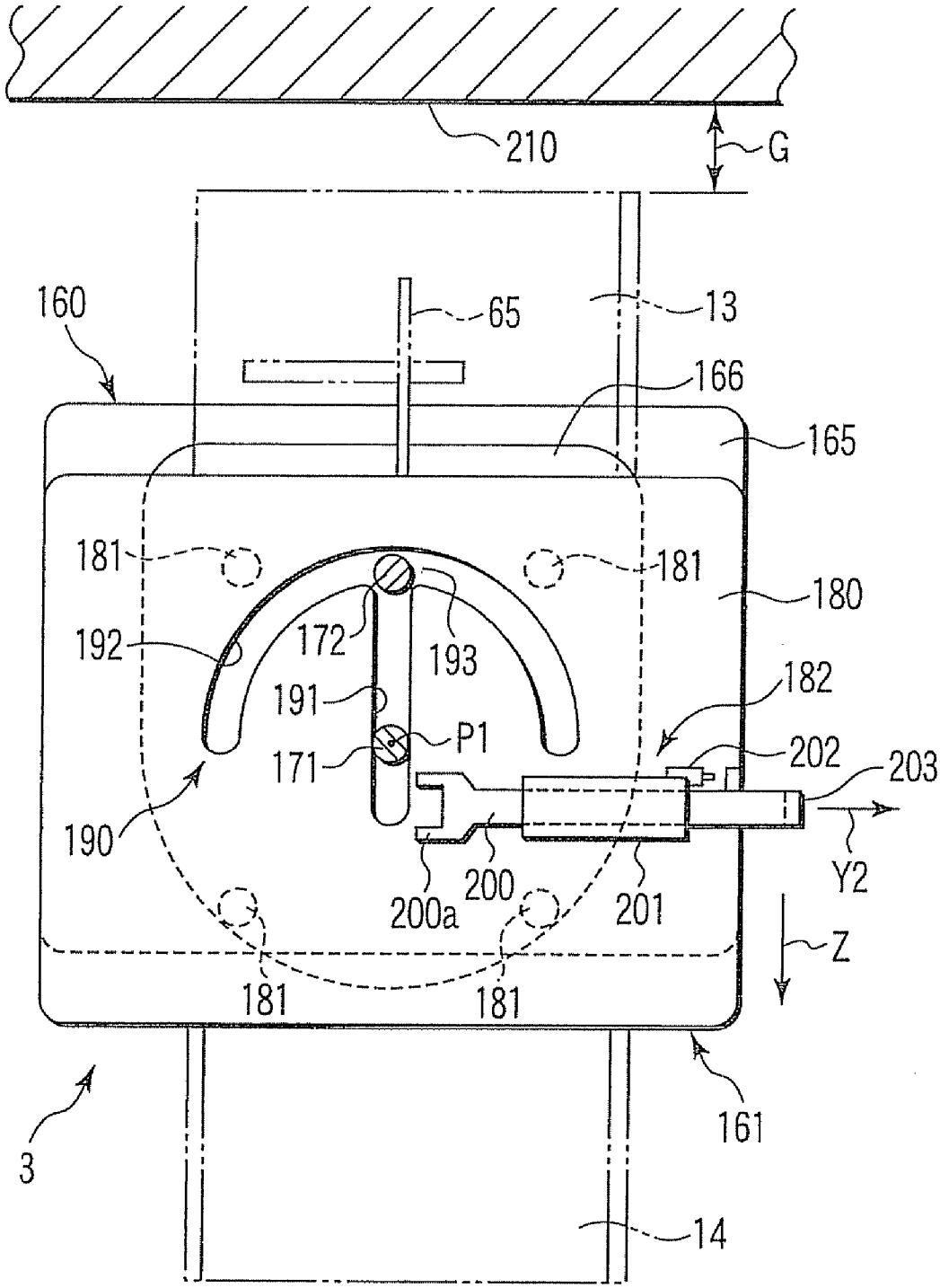
FIG. 8 is a plan view in which the movable unit of the supporting mechanism of the image forming apparatus shown in FIG. 1 is in a second position.

The movable unit 161 is movable in the front-to-rear direction of the base member 160 from a first position shown in FIG. 7 to a second position shown in FIG. 8 with respect to the base member 160. Moreover, this movable unit 161 can rotate by about 90° in the clockwise direction and the counterclockwise direction from the second position, respectively.

As shown in FIG. 7, when the turntable 180 is in the first position, the first shaft 171 and the second shaft 172 are located in the first guide 191. Therefore, the turntable 180 cannot rotate. In other words, the first shaft 171, the second shaft 172, and the first guide 191 constitute a rotation stopping mechanism for preventing the turntable 180 from rotating in the first position.

As shown in FIG. 8, when the turntable 180 is in the second position, the first shaft 171 is located in the midpoint P1 of the first guide 191 and the second shaft 172 is located in the communicating section 193. Therefore, when the turntable 180 is in the second position, the turntable 180 can rotate in a horizontal plane in the clockwise direction and the counterclockwise direction around the midpoint P1.

Figure 9:
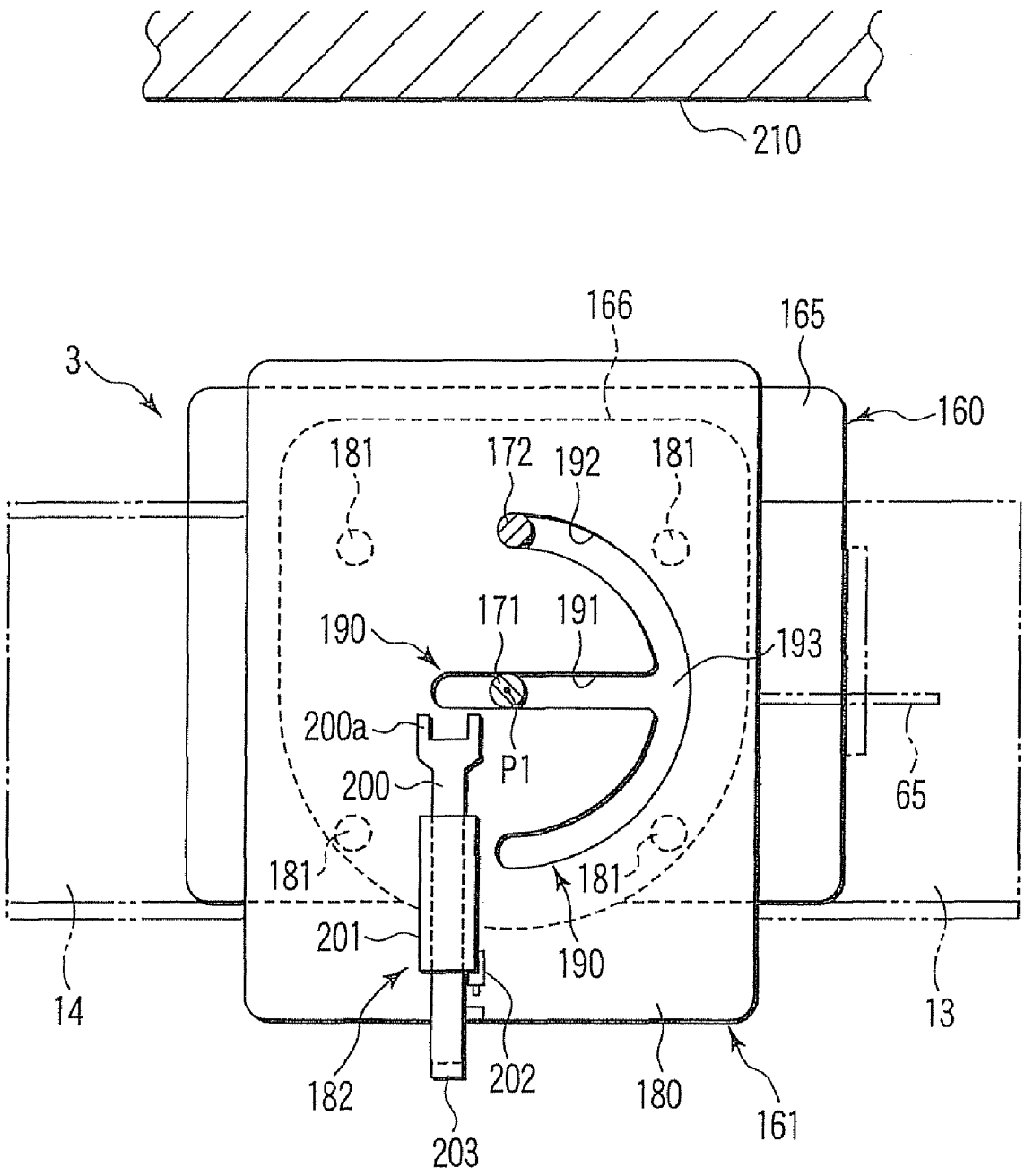
FIG. 9 is a plan view in which the movable unit of the supporting mechanism of the image forming apparatus shown in FIG. 1 is in a third position.

In other words, the turntable 180 can rotate in the horizontal plane around an axis X in the up-to-down direction shown in FIG. 2. The first shaft 171, the second shaft 172, the casters 181, and the guide section 190 constitute a rotating mechanism for allowing the turntable 180 to rotate in the second position. For example, when the turntable 180 is rotated by about 90° in the clockwise direction in FIG. 8, as shown in FIG. 9, the turntable 180 moves to a third position. When the turntable 180 moves to the third position, the second shaft 172 moves among the arc of the second guide 192.

The lock mechanism 182 has a lock member 200, a holder 201, a lock detection sensor 202, and the like. The lock member 200 can move in directions indicated by arrows Y1 and Y2 in FIG. 7. In other words, the lock member 200 can move to a lock position shown in FIG. 7 and a lock release position shown in FIG. 8. The holder 201 supports the lock member 200 to allow the lock member 200 to move in the arrow Y1 and Y2 directions. When the turntable 180 is in the first position, a locking section 200*a* of the lock mechanism 200 can fit in the first shaft 171. This state is a lock position.

The lock detection sensor 202 has a function of detecting that the lock member 200 is in the lock position. When the lock state is detected by the lock detection sensor 202, a signal for permitting a printing operation of the image forming unit 2 is outputted to the control unit 50. An operation unit 203 is provided in the lock member 200. When the operation unit 203 is moved in the lock release direction (the arrow Y2 direction), the locking section 200*a* of the lock member 200 moves away from the first shaft 171, whereby the lock is released. This state is a lock release state. When the lock release state is detected by the lock detection sensor 202, a signal for prohibiting the printing operation of the image forming unit 2 is outputted to the control unit 50.

Operations of the image forming apparatus 1 including the supporting mechanism 3 will be hereinafter explained.

This image forming apparatus 1 is placed on a desk (not shown) or the like and used. When the image forming apparatus 1 is used, as shown in FIG. 7, the feed tray 13 provided on the rear surface side of the main body unit 11 may be close to a wall 210. In this case, the turntable 180 is in the first position and the locking section 200*a* of the lock member 200 fits in the first shaft 171. Therefore, the image forming unit 2 is fixed. In this state, if the sheet S is supplied to the feed tray 13 and a print start switch (not shown) is operated, it is possible to print an image on the sheet S with the image forming unit 2. However, in this state, since the feed tray 13 is in a position distant from the operator, it is difficult to see the feed tray 13. Therefore, it is difficult to accurately set the sheet S in a predetermined position of the feed tray 13.

Thus, a direction of the image forming unit 2 is changed. First, the operation unit 203 of the lock mechanism 182 is moved to the lock release position (the arrow Y2 direction shown in FIG. 8) to separate the locking section 200*a* of the lock member 200 from the first shaft 171. When the lock by the lock mechanism 182 is released, the lock detection sensor 202 outputs a signal for prohibiting the printing operation by the image forming unit 2 to the control unit 50.

When the lock by the locking mechanism 182 is released, the turntable 180 can move in the front-to-rear direction along the first guide 191. In this state, the turntable 180 is moved in an arrow Z direction to the second position shown in FIG. 8. In this case, the first shaft 171 and the second shaft 172 move along the first guide 191, respectively. The second shaft 172 is located in the communicating section 193.

When the turntable 180 moves to the second position as shown in FIG. 8, the image forming unit 2 moves in the same direction. Therefore, the feed tray 13 moves away from the wall 210 and a gap G between the feed tray 13 and the wall 210 widens. Therefore, when the turntable 180 is rotated, the feed tray 13 is prevented from striking against the wall 210.

After the turntable 180 is moved to the second position, the turntable 180 is rotated, for example, in the clockwise direction around the first shaft 171. In this case, the turntable 180 rotates in the horizontal plane around the axis X in the up-to-down direction shown in FIG. 2. When the turntable 180 rotates, the second shaft 172 moves along the second guide 192 of an arcuate shape.

As shown in FIG. 9, when the turntable 180 rotates by about 90° to reach the third position, the feed tray 13 is located near the right side of the operator. Therefore, it is possible to easily perform work for setting the sheet S on the feed tray 13. Further, since it is easy to view the movable guide 65, it is possible to move the movable guide 65 to an optimum position according to the width of the sheet S.

After the sheet S is placed in the predetermined position of the feed tray 13, the turntable 180 is returned to the second position (FIG. 8). Further, the turntable 180 is returned to the first position (FIG. 7). Thereafter, the turntable 180 is locked by moving the lock mechanism 182 to the lock position. Then, a signal for permitting printing is outputted to the control unit 50 of the image forming unit 2. Therefore, the image forming unit 2 comes into a standby state in which printing is possible.

Under the standby state, a print start switch (not shown) is operated. Consequently, the sheet conveying mechanism 21, the carriage driving mechanism 31, and the like operate, an ink is ejected from the recording head 32 to the sheet S, and printing is performed. At the printing time, the image forming unit 2 is locked by the lock mechanisms 182. Therefore, the turntable 180 is prevented from moving at the printing time. It is possible to prevent irregularity of printing due to a shake of the image forming unit 2.

The lock mechanism 182 may lock the turntable 180 in a state in which the turntable 180 has rotated to the third position. The lock mechanism 182 may be able to lock the turntable 180 at a desired rotation position.

As explained above, the respective embodiments include the following steps:

moving the image forming unit 2 placed on the turntable 180 from the first position to the second position on the front side along the first guide 191 with respect to the base member 160;

moving the image forming unit 2 to the third position by rotating the image forming unit 2 around the axis X in the up-to-down direction in a state in which the image forming unit 2 has moved to the second position;

supplying the sheet S onto the feed tray 13 of the image forming unit 2 in a state in which the image forming unit 2 has moved to the third position;

locking the image forming unit 2 with the lock mechanism 182 not to move;

outputting a signal for permitting printing to the image forming unit 2 after the image forming unit is locked by the lock mechanism 182; and forming an image on the sheet S with the recording head 32.

According to the embodiment, even if the feed tray 13 is provided in the rear part of the image forming unit 2, it is possible to bring the feed tray 13 close to the operator by rotating the image forming unit 2 when sheets are set. Therefore, it is possible to easily perform work for setting sheets in the feed tray 13.

The base member 160 and the movable unit 161 are not limited to the embodiment. For example, the lock mechanism 182 may perform lock and lock release of the turntable 180 with an electric actuator. It is possible to control the electric actuator with the control unit 50. When the turntable 180 is in the first position, the turntable 180 is fixed by moving the lock mechanism to the lock position with this actuator. In a state in which the turntable 180 is locked, it is possible to perform printing by the image forming unit 2.

It is also possible to implement the guide section 190 in various forms other than the embodiment. In short, the supporting mechanism 3 only has to include a guide section that guides the turntable 180 to move from the first position to the second position, a rotation stopping mechanism that prevents the turntable 180 from rotating when the turntable 180 is in the first position, and a rotating mechanism that allows the turntable to rotate in the horizontal plane in a state in which the turntable has moved to the second position.

It is also possible to apply the invention to an image forming apparatus for printing an image on sheets other than a print sheet, for example, sheets made of paper of various forms, cloth, plastics, and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. An image forming apparatus that has an image forming unit including a recording head for printing an image on a sheet, the image forming apparatus comprising:

sheet placing means that is provided in a rear part of the image forming unit and on which the sheet is placed;

base means that has an upper surface;

turntable means is arranged on the base means and is movable along the upper surface of the base means, and supporting the image forming unit;

guide means for guiding the turntable means to move from a first position to a second position in which the rear edge of the turntable means is farther from the front edge of the base means if in the second position;

rotation stopping means for preventing the turntable means from rotating if the turntable means is in the first position; and rotating means for allowing the turntable means to rotate around an axis in a state in which the turntable means has moved to the second position, the axis being in an up-to-down direction.

2. An image forming apparatus according to claim 1, comprising lock means for fixing the image forming unit to the base means.

3. An image forming apparatus according to claim 2, comprising control means for permitting printing if the turntable means is locked by the lock means and prohibiting printing if the lock means is in a lock release position.

* * * * *